US009021834B2

(12) United States Patent
Jarrell et al.

(10) Patent No.: US 9,021,834 B2
(45) Date of Patent: May 5, 2015

(54) COLLAPSIBLE RETAINING STRUCTURE FOR BODY PIERCING JEWELRY

(75) Inventors: Jesse Jarrell, Portland, OR (US); Steve A. Haworth, Phoenix, AZ (US)

(73) Assignee: Kaos Software, LLC, Portland, OR (US)

( * ) Notice: Subject to any disclaimer, the term of this patent is extended or adjusted under 35 U.S.C. 154(b) by 78 days.

(21) Appl. No.: 13/344,082

(22) Filed: Jan. 5, 2012

(65) Prior Publication Data

US 2013/0174606 A1 Jul. 11, 2013

(51) Int. Cl.
*A44C 7/00* (2006.01)
*A44C 17/02* (2006.01)

(52) U.S. Cl.
CPC ..... *A44C 7/003* (2013.01); *A44C 17/0208* (2013.01)

(58) Field of Classification Search
CPC ..... A44C 15/0035; A44C 15/00; A44C 15/0045; A44C 15/0095; A44C 7/003; A44C 13/00; A61B 5/6816; Y10S 24/91; Y10S 63/03; F16B 13/04; F16B 13/045
USPC ..... 63/12, 13, 1.18; 24/705, 453
See application file for complete search history.

(56) References Cited

U.S. PATENT DOCUMENTS

| | | | | | |
|---|---|---|---|---|---|
| 229,080 | A | * | 6/1880 | Ballou | 63/13 |
| 2,990,988 | A | * | 7/1961 | Ziegenbein | 24/265 WS |
| 3,621,751 | A | * | 11/1971 | Fiorentino | 411/508 |
| 3,805,439 | A | * | 4/1974 | Krengel et al. | 43/43.1 |
| 4,129,998 | A | * | 12/1978 | Ferro | 63/12 |
| 5,076,072 | A | * | 12/1991 | Payne | 63/12 |

FOREIGN PATENT DOCUMENTS

JP 2013085699 A * 5/2013

* cited by examiner

*Primary Examiner* — Jack W Lavinder
(74) *Attorney, Agent, or Firm* — Chernoff, Vilhauer, McClung & Stenzel, LLP

(57) ABSTRACT

Flexible retaining structures for body jewelry and method for their use.

1 Claim, 2 Drawing Sheets

COLLAPSIBLE RETAINING STRUCTURE FOR BODY PIERCING JEWELRY

BACKGROUND

The present invention relates generally to body jewelry and more specifically to collapsible retaining structures for body piercing jewelry that are soft and/or flexible enough to be easily compressed. In this way the retainer can easily pass through the same piercing canal that it retains the jewelry within, and will securely hold a cylindrical transdermal portion of jewelry within the piercing canal.

It can be appreciated that body jewelry has been in use for years. Typically, body jewelry is comprised of machined surgical steel, titanium, and/or gold; glass forms, carved stone, bone and/or wood; or molded and/or machined polymers of various consistencies. Such jewelry is typically inserted into piercing canals, which are holes passing through the skin of a wearer. In order to be retained in the piercing canal, the jewelry must either have a shape that requires manipulation in several directions for removal (such as the bent wire hooks common on earrings), have an openable hoop or ring that can be closed after insertion, or be sized such that some part of the body jewelry is larger than the piercing canal, and cannot pass easily through.

The main problem with the third type described above is that most body jewelry of this type is comprised of at least two separable parts. One or more end caps, beads, or O-rings must be removed to allow the jewelry to be inserted into a piercing, and then replaced to maintain the jewelry in the piercing. These extra retaining bodies are easily lost and sometimes difficult to operate. Other jewelry designs may instead utilize a rigid enlarged rim to hold the jewelry in place, but this rim must be forced through the smaller piercing canal and often results in pain for the user. Another problem with conventional body jewelry is that, when worn, most jewelry designs can be caught and entangled by other objects or outside forces, and if forced from the piercing can severely damage or destroy the piercing canal in which it was seated. Another problem with conventional body jewelry is that when a piercing that contains jewelry with rigid retaining elements becomes infected or inflamed, the retaining bodies may become embedded in the swollen tissue around the piercing, or even forced into the piercing canal itself by the expansion of swelling tissue around the jewelry, causing further damage to an already irritated piercing.

SUMMARY

In view of the disadvantages inherent in prior art body jewelry, the present invention provides collapsible retaining structures which are soft and/or flexible enough to be easily compressed with appropriate force, so that the retaining structure can easily pass through the piercing canal, and will securely hold the transdermal portion of jewelry in that canal.

To attain this, the present invention generally comprises a collapsible retaining body connected to a transdermal portion of a piece of piercing jewelry, the latter lying within a piercing canal. The retaining body is soft and/or flexible enough to be stretched such that its cross-section contracts to allow it to pass through a piercing canal and then expand once beyond the canal to keep the jewelry in place.

The foregoing and other objectives, features, and advantages of the invention will be more readily understood upon consideration of the following detailed description of the invention taken in conjunction with the accompanying drawings.

BRIEF DESCRIPTION OF THE SEVERAL DRAWINGS

DETAILED DESCRIPTION

The attached figures illustrate various systems of collapsible retaining structures for body jewelry, which comprises a collapsible retaining body that is soft and/or flexible enough to be stretched such that its cross-section contracts to allow it to pass through a piercing canal.

For the purposes of this application, "cross-section" refers to the diameter of the smallest circle which encloses all parts of the item of jewelry at a given point. The circle is drawn in a plane perpendicular to an axis defined by the transdermal portion as it is intended to pass through the piercing canal.

Figure 1A:
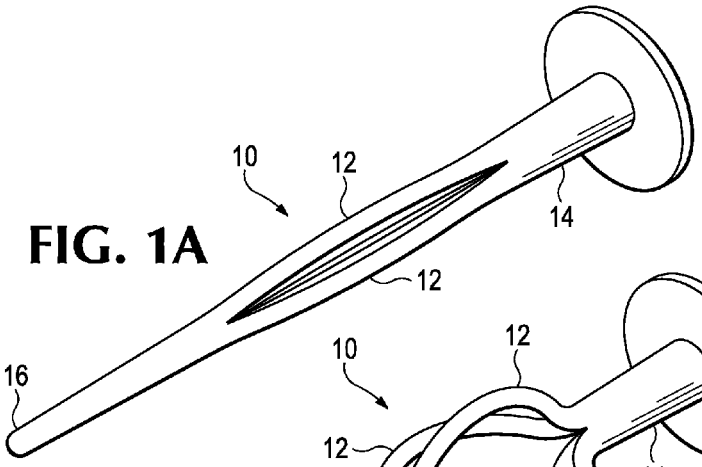
FIG. 1A is one embodiment of a jewelry retaining structure in the form of a web, depicted in its stretched or insertable configuration, as when a user pulls on it.
Figure 1B:
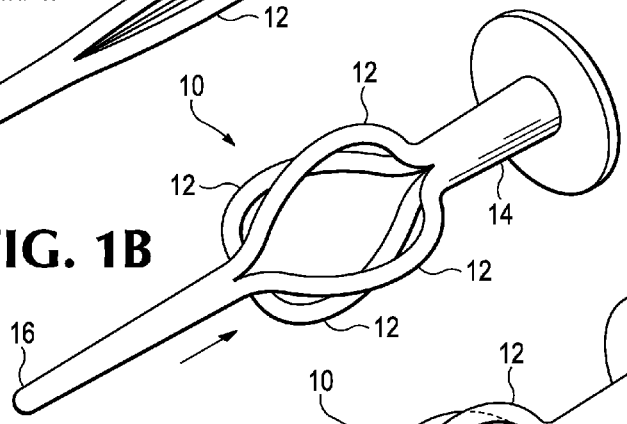
FIG. 1B shows the jewelry of FIG. 1A in its relaxed or retaining configuration, to which it returns when tension is released.
Figure 1C:
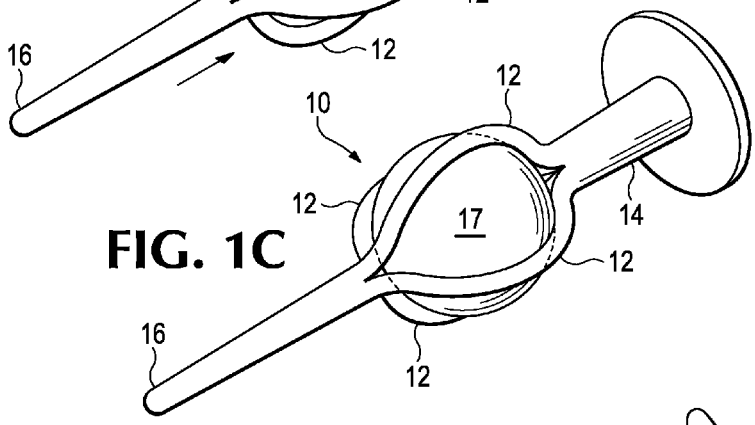
FIG. 1C shows the jewelry of FIG. 1A with a rigid object inserted into the web to lock it in its expanded configuration.

FIGS. 1A-C show a retaining body 10 made of a flexible polymer having a cage structure. Filaments 12 deviate outward from the cylindrical transdermal portion 14 of the jewelry, such that the structure naturally has a cross-section larger than the transdermal portion 14. The filaments 12 of the retaining body 10 recombine into a tapering leader 16. At least three such filaments 12 are necessary to form the cage structure. The end of the leader 16 may be passed into the piercing canal, grasped from the opposite side, and pulled so that the retaining body 10 is stretched to a flattened state as shown in FIG. 1A, allowing it to pass easily through the piercing canal. When released the retaining body 10 will expand and return to its original form as shown in FIG. 1B. It may be locked in this shape by insertion of a separate rigid locking object 17 of appropriate size and shape (see FIG. 1C).

Figure 2A:
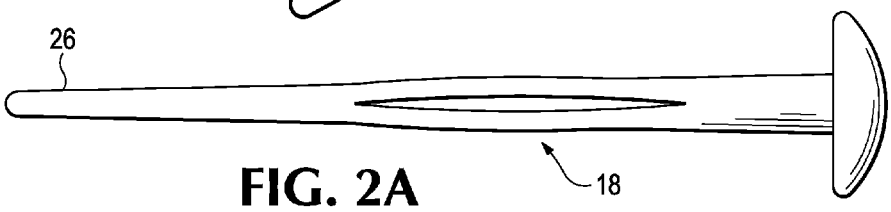
FIG. 2A shows an alternate embodiment of a jewelry retaining structure consisting of a simple loop, in its stretched or insertable configuration, as when a user pulls on it.
Figure 2B:
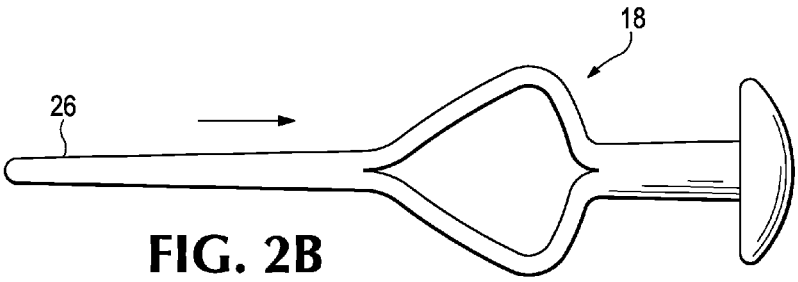
FIG. 2B shows the jewelry of FIG. 2A in its relaxed or retaining configuration, to which it returns when tension is released.
Figure 2C:
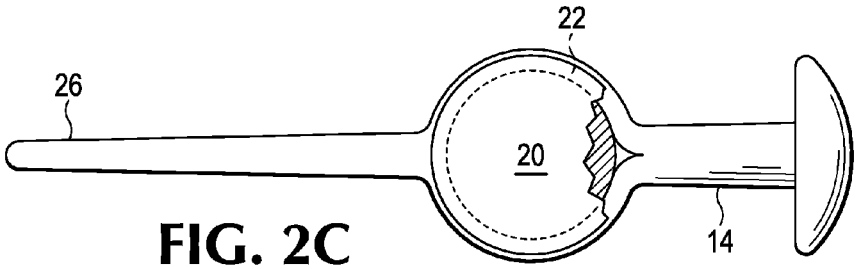
FIG. 2C shows the jewelry of FIG. 2A with a rigid object inserted into the loop to lock it in its expanded configuration.
Figure 2D:
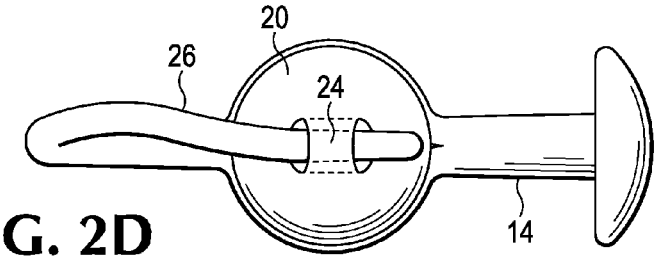
FIG. 2D shows the jewelry of FIG. 2A with a rigid object inserted into the loop to lock it in its expanded configuration and the leader tucked into an opening in the rigid object.

In FIGS. 2A-D, the retaining body is a simple single loop 18 that can be stretched near flatness as shown in FIG. 2A. Single loop 18 may have a separate rigid locking object 20 inserted within it for decoration or to hold the loop 18 in its retaining state as shown in FIG. 2C. This rigid locking object 20 may have grooves 22 in which the loop 18 may lie once inserted, or the rigid locking object 20 may be maintained within the loop 18 only by tension. The rigid locking object 20 may also include a small hole 24 that the leader 26 could be tucked into when the jewelry is worn as shown in FIG. 2D.

Figure 3B:
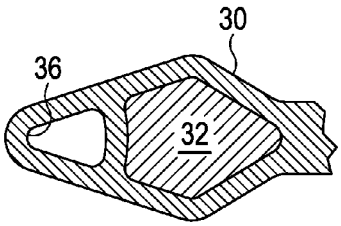
FIG. 3B shows a cross-section through the middle of the jewelry shown in FIG. 3A, showing the hollow center.
Figure 3A:
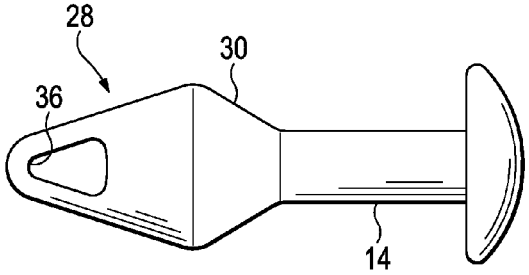
FIG. 3A shows an alternate embodiment of a jewelry retaining structure in the form of a hollow shell with a hook-eye.
Figure 3C:
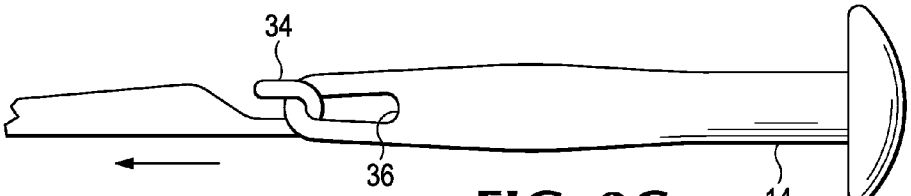
FIG. 3C shows a hook being used to stretch the jewelry shown in FIG. 3A into its stretched or insertable configuration.

FIGS. 3A-C shows a flexible polymer retaining body 28 that is neither a loop nor cage-like structure, but has a hollow shell 30 surrounding an interior 32 which is either filled with air or another compressible material. Such an interior 32 would allow the retaining body 28 to be compressed into a narrowed state as shown in FIG. 3C by utilizing a detachable hook 34 as a leader, by temporarily attaching the hook 34 to the hook-eye 36, and passing the hook 34 through the piercing canal to stretch the retaining body 28. Such a hollow shell design could alternately utilize a long tapering leader similar to that shown in FIG. 2. Other designs for a detachable leader are also possible.

Figure 4:
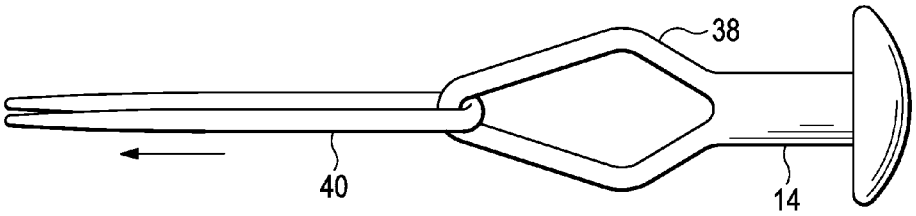
FIG. 4 shows an alternative embodiment of a jewelry retaining structure in the form of a leaderless loop, with a thin leader formed of a folded tapering cylinder temporarily inserted to stretch the structure into an insertable configuration.

FIG. 4 depicts another embodiment. A hook-eye 36 could be substituted by a simple loop 38 without any leader extending from the transdermal portion 14 of the jewelry. Such a loop 38 or any opening found in the retaining body could be inserted using the hook 34 as a leader. Alternatively a detachable thin cylinder 40 of flexible polymer that is tapered at both ends can be folded through a loop 38 or hook-eye 36 to serve as the leader for stretching and insertion.

In addition to the simple loops, hollow shapes, and cages shown here, collapsible retaining bodies could be designed as any structure of various complexities embodying the mechanical characteristics described above. These structures may vary in rigidity throughout their geometry to accommodate the mechanical function of a given part of the jewelry, or the entire item may be of a single consistency. The retaining body may be detachably mounted or it may be an integral part of the jewelry.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. An article of jewelry comprising:

a. a transdermal portion having a cross-section;

b. a collapsible retaining body cage structure being attached at one end to the transdermal portion such that, when free from outside forces, has a cross-section larger than the transdermal portion cross-section, said collapsible retaining body cage structure being elastically deformable to collapse said collapsible retaining body cage structure cross-section to be less than or equal to said transdermal portion cross-section;

c. a leader attached to an end of said collapsible retaining body cage structure opposite the one end of said collapsible retaining body cage structure, and having a cross-section less than or equal to said transdermal portion cross-section; and d. further comprising a rigid locking object so sized as to be insertable into said collapsible retaining body cage structure when said collapsible retaining body cage structure is free from outside forces.

* * * * *